US005324941A

United States Patent [19]

Gross et al.

[11] Patent Number: 5,324,941

[45] Date of Patent: Jun. 28, 1994

[54] TENSION SUPPORT MOUNTING FOR A CORONA GENERATING DEVICE

[75] Inventors: Robert A. Gross, Penfield; Bruce D. Caryl, Fairport, both of N.Y.

[73] Assignee: Xerox Corporation, Stamford, Conn.

[21] Appl. No.: 762

[22] Filed: Jan. 5, 1993

[51] Int. Cl.[5] ..... H01T 19/04

[52] U.S. Cl. ..... 250/324

[58] Field of Search ..... 250/324, 325, 326; 355/225

[56] References Cited

U.S. PATENT DOCUMENTS

| | | | |
|---|---|---|---|
| 3,691,373 | 9/1972 | Compton et al. | 250/49.52 C |
| 3,790,999 | 2/1974 | Gallo | 250/326 |
| 3,908,127 | 9/1975 | Clark | 250/325 |
| 3,943,418 | 3/1976 | Quang | 250/324 |
| 4,110,811 | 8/1978 | Hubble, III et al. | 361/225 |
| 4,320,957 | 3/1982 | Brown et al. | 250/324 |
| 4,725,732 | 2/1988 | Lang et al. | 250/326 |
| 5,101,107 | 3/1992 | Stoot | 250/324 |

*Primary Examiner*—Bruce C. Anderson

[57] ABSTRACT

A tension support mounting for applying tension to the corona generating electrode of a corona generating device. Various embodiments are described wherein the corona generating electrode is fastened to a mounting block including an electrode support member, the position of which can be varied for applying variable tension to the corona generating electrode.

21 Claims, 5 Drawing Sheets

TENSION SUPPORT MOUNTING FOR A CORONA GENERATING DEVICE

The present invention relates generally to corona charging devices, and more particularly concerns a tension support mounting for supporting a corona generating electrode in a corona generating device utilized in electrostatographic applications.

Generally, the process of electrostatographic copying is executed by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. The electrostatic latent image is subsequently developed into a visible image by a process in which a charged developing material is deposited onto the photoconductive surface of the photoreceptor such that the developing material is attracted to the charged image areas thereon. The developing material is then transferred from the photoreceptive member to a copy sheet on which the image may be permanently affixed to provide a reproduction of the original document. In a final step, the photoconductive surface of the photoreceptive member is cleaned to remove any residual developing material therefrom in preparation for successive imaging cycles.

The described process is well known and is useful for light lens copying from an original, as well as for printing documents from electronically generated or stored originals. Analogous processes also exist in other electrostatographic applications such as, for example, digital printing applications wherein the latent image is generated by a modulated laser beam or ionographic printing and reproduction, where charge is selectively deposited on a charge retentive surface in accordance with an image stored in electronic form.

In electrostatographic applications, it is common practice to use corona generating devices for providing electrostatic fields to drive various machine operations. Such corona devices are primarily used to deposit charge on the photoreceptive member prior to exposure to the light image for subsequently enabling toner transfer thereto. In addition, corona devices are used in the transfer of an electrostatic toner image from a photoreceptor to a transfer substrate, in tacking and detacking paper to or from the imaging member by applying a neutralizing charge to the paper, and, generally, in conditioning the imaging surface prior to, during, and after toner is deposited thereon to improve the quality of the xerographic output copy. Because a relatively large number of corona generating charging devices are required to accomplish the many various operations in a single electrostatographic machine, a minor reduction in unit cost may reap significant cost advantages per machine, particularly in light of replacement cycles in a machine.

The conventional form of corona generating charging device used in electrostatographic reproduction systems is generally shown in U.S. Pat. No. 2,836,725. That patent discloses a basic corotron device wherein a conductive corona generating electrode in the form of an elongated wire is partially surrounded by a conductive shield. The corona generating electrode, or so called coronode, is provided with a DC voltage, while the conductive shield is usually electrically grounded and the dielectric surface to be charged is spaced proximate to the wire. Alternatively, the corotron device may be biased in a manner taught in U.S. Pat. No. 2,879,395, which describes a device known as a scorotron, wherein an AC corona generating potential is applied to the conductive wire electrode while a DC biasing potential is applied to a conductive shield partially surrounding the electrode. This DC potential regulates the flow of ions from the electrode to the surface to be charged so that the charge rate can be adjusted, making this biasing system ideal for self-regulating systems. Countless other charging and biasing arrangements are known in the art and will not be discussed in great detail herein.

In one type of preferred charging device, a charging electrode may be provided in the form of an electrically conductive strip having projections, scalloped portions, or teeth members integrally formed with, and extending from, a longitudinal edge of the electrode. This arrangement provides significant structural and operational advantages over other types of electrode devices such as thin wire electrodes, including comparatively high structural strength and reduced levels of undesirable ozone emissions. In this respect, U.S. Pat. No. 3,691,373 to Compton et al. demonstrates a corona generating device generally comprising an electrically conductive electrode strip or pin array supported on either side by support strips, and mounted within an electrically non-conductive base member. One of the side strips is adapted for connection to an exterior connector from a high voltage source. The electrode is fixed into position within the base member by a plurality of transverse pins which fit through matching holes in the base member, the pin array, and the support strips. The corona generating device disclosed therein may further include a screen and/or an auxiliary electrode as well as various additional conductive shields for regulating charging current to control uniformity of charge. A detailed description and illustration of pin array corona generating devices, specifically describing the mounting mechanism used to support a pin array electrode in a corotron device is provided in U.S. Pat. Nos. 4,725,732 and 4,792,680, the entire contents of which are hereby incorporated by reference herein.

Several problems have historically been associated with the unique design of pin array corona generating devices. Generally, it is important that the pin array electrode, which is typically stretched between mountings at opposite ends of the corona generating device, is maintained in taut condition. Any looseness and/or kinks in the electrode member may result in a non-uniform charge derived from the corona generating device. In order to insure that the electrode member is sufficiently supported, the pin array electrode is conventionally mounted between support members, as shown in U.S. Pat. Nos. 4,725,732 and 4,792,680, previously referenced.

It is also desirable in corona generating devices to provide an arrangement for easily replacing a deteriorated corona generating electrode upon failure, or preferably, for replacing a corona generating electrode prior to failure through preventative maintenance. Typically, the replacement of a pin array electrode necessitates replacement of the entire assembly of the corona generating device, creating waste and additional expense. Since replacement is usually handled by a service technician at the commercial site at which the machine is located, ease of replacement and adjustment in a minimum amount of time is essential. Thus, it is an object of the present invention to provide a pin array corona generating device that is cost effective and serviceable while eliminating waste by permitting the replacement and adjustment of the corona generating electrode within a corona generating device.

The following disclosures may be relevant to various aspects of the present invention:

U.S. Pat. No. 3,691,373
Patentee: Compton, et al.
Issued: Sep. 12, 1972
U.S. Pat. No. 4,110,811
Patentee: Hubble III, et al.
Issued: Aug. 29, 1978
U.S. Pat. No. 4,725,732
Patentee: Lang, et al.
Issued Feb. 16, 1988
U.S. Pat. No. 5,101,107
Patentee: Stoot
Issued: Mar. 31, 1992

The relevant portions of the foregoing disclosures may be briefly summarized as follows:

U.S. Pat. No. 3,691,373 discloses a corona charging device comprising an electrically nonconductive base member having a pin array type corona generating member mounted in the central slot thereof. The corona generating member comprises an electrically conductive central strip having a number of projections along the top edge, being supported by a pair of side strips positioned on either side. The corona generating member is held together and fastened to the nonconductive base member by a number of transverse pins fitted into matching holes in the central and side strips.

U.S. Pat. No. 4,110,811 discloses a corona generating device including a corona generating electrode in the form of a wire supported between insulating end block assemblies. Each assembly is constructed of mating half-sections which jointly define a substantially closed and insulated cavity lined with a conductive insert, wherein the electrode is held taut by means of a loaded compression spring carried within the insert on one half-section, the spring bearing against a conductive insert on the end and against a second conductive bead varied by the other end of the electrode.

U.S. Pat. No. 4,725,732 discloses a corona charging device including at least one pin array electrode having interlocking pin array support members and integral pin projections.

U.S. Pat. No. 5,101,107 discloses a corona device in which the ion-generating element is an array of pin electrodes which are secured to and insulated from a housing open on at least one side and profiled auxiliary electrodes disposed in the vicinity of the pin electrodes in a plane perpendicular to the possibly imaginarily lengthened pin electrodes. The imaginary connecting lines between the tops of the auxiliary electrodes pass substantially through the tops of the pin electrodes or the pin electrodes imaginarily lengthened in the direction of the open side.

In accordance with one aspect of the present invention, a corona generating device is disclosed, including an electrode member for generating a corona, means for supporting the electrode member, and means for selectively applying tension to the electrode member being supported by the supporting means.

These and other aspects of the present invention will become apparent from the following description in conjunction with the accompanying drawings, in which.

Figure 1:
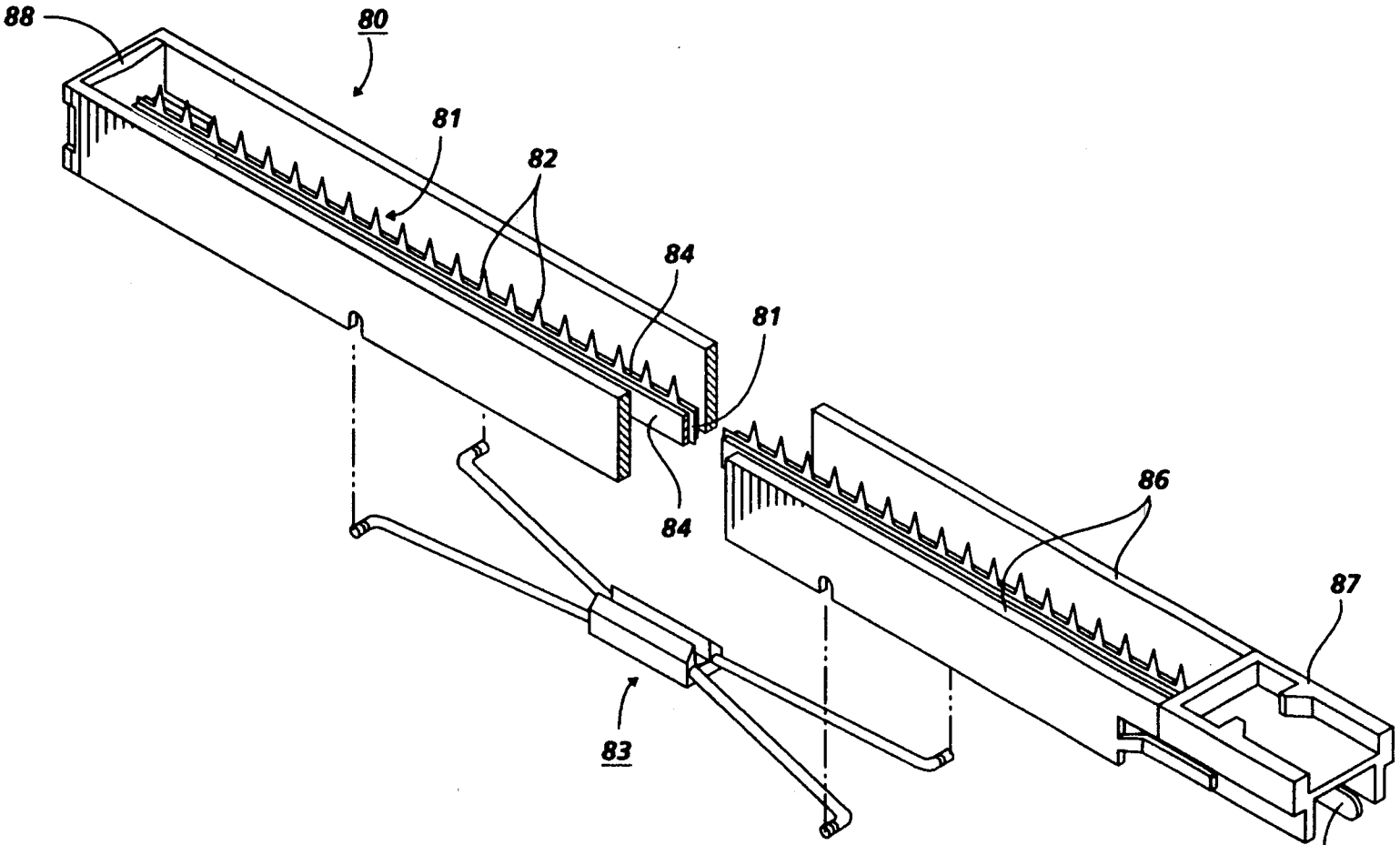
FIG. 1 PRIOR ART
FIG. 1 is a perspective view of a prior art pin array corona generating device.

For a general understanding of the features of the present invention, reference is made to the drawings wherein like reference numerals have been used throughout the several figures where possible to designate corresponding elements of various embodiments. While the present invention will be described in terms of various preferred embodiments, it will be understood that the invention is not to be limited to these preferred embodiments. On the contrary, the present invention is intended to cover all alternatives, modifications, and equivalents as may be included within the spirit and scope of the invention as defined by the appended claims.

Figure 9:
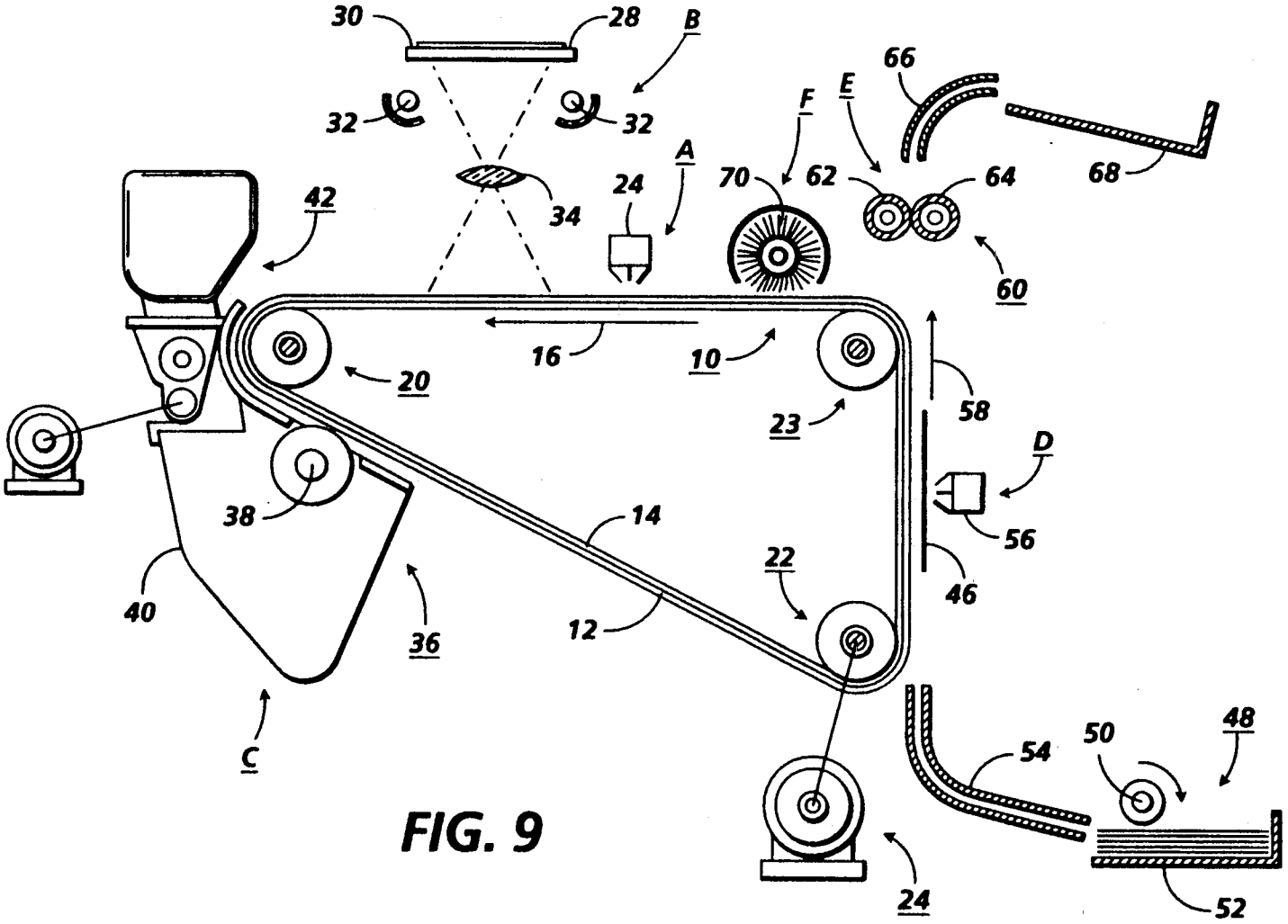
FIG. 9 is a schematic view showing an electrophotographic copying apparatus employing a corona generating device of the present invention.

Referring initially to FIG. 9, prior to describing the specific features of the present invention, a schematic depiction of the various components of an exemplary electrophotographic reproducing apparatus incorporating the corona generating assembly of the present invention is provided. Although the apparatus of the present invention is particularly well adapted for use in an electrophotographic reproducing machine, it will become apparent from the following discussion that the present corona generating device is equally well suited for use in a wide variety of electrostatographic processing machines as well as other systems requiring the use of a corona generating device. Thus, the invention is not necessarily limited in its application to the particular embodiment or embodiments shown herein. In particular, it should be noted that the corona generating device of the present invention, described hereinafter with reference to an exemplary charging system, may also be used in the toner transfer, detack, or cleaning subsystems of a typical electrostatographic copying or printing apparatus since such subsystems also require the use of a corona generating device.

The exemplary electrophotographic reproducing apparatus shown in FIG. 9 employs a photoreceptive belt 10 including a photoconductive surface 12 deposited on an electrically grounded conductive substrate 14. A drive roller 22, coupled to motor 24 by any suitable means, as for example, via a drive belt, engages with belt 10 for moving belt 10 about a curvilinear path defined by drive roller 22, and rotatably mounted tension rollers 20, 23. This system of rollers is used for advancing successive portions of photoconductive surface 12 in the direction of arrow 16, through various processing stations disposed about the path of movement of belt 10, as will be described.

Initially, a segment of belt 10 passes through a charging station A. At charging station A, a corona generating device in accordance with the present invention, indicated generally by reference numeral 24, charges photoconductive surface 12 to a relatively high, substantially uniform potential. The corona generating device will be described in detail following the present discussion of the electrostatographic machine.

Once charged, photoconductive surface 12 is advanced to an imaging station B where an original document 28, positioned face down upon a transparent platen 30, is exposed to a light source, i.e., lamps 32. Light rays from this light source 32 are reflected to form a light image of the original document which is transmitted through a lens 34 and focused onto the charged portion of photoconductive surface 12 for selectively dissipating the charge thereon. This process records an electrostatic latent image corresponding to the original document 28 onto photoconductive surface 12. Although an optical system has been shown and described for forming the light image used to selectively discharge the charged photoconductive surface 12, one skilled in the art will appreciate that a properly modulated scanning beam of energy (e.g., a laser beam) may be used to irradiate the charged portion of the photoconductive surface 12 in order to record the latent image thereon.

After the electrostatic latent image is recorded on photoconductive surface 12, belt 10 advances to development station C where a magnetic brush development system, indicated generally by reference numeral 36, deposits developing material onto the electrostatic latent image. Magnetic brush development system 36 generally includes a single developer roller 38 disposed in a developer housing 40. In the developer housing 40, toner particles are mixed with carrier beads, generating an electrostatic charge therebetween which causes the toner particles to cling to the carrier beads to form developing material. The developer roller 38 rotates and attracts this developing material to form a magnetic brush having carrier beads and toner particles magnetically attached thereto. Thus, as developer roller 38 rotates, developing material is brought into contact with photoconductive surface 12 such that the latent image thereon attracts the toner particles of the developing material and the latent image on photoconductive surface 12 is developed into a visible image. A toner particle dispenser, indicated generally by the reference numeral 42, furnishes a supply of additional toner particles to housing 40 to sustain the developing process.

After the toner particles have been deposited onto the electrostatic latent image for development thereof, belt 10 advances the developed image to transfer station D, where a sheet of support material 46 is moved into contact with the developed toner image by means of a sheet feeding apparatus 48 via a chute 54. Preferably, sheet feeding apparatus 48 includes a feed roller 50 which rotates while in contact with a stack of sheets 52 to advance the uppermost sheet into chute 54. Chute 54 directs the advancing sheet of support material 46 into contact with photoconductive surface 12 of belt 10 in a timed sequence so that the developed image thereon contacts the advancing sheet of support material 46 and is transferred thereon at transfer station D. A transfer corotron 56 is provided for projecting ions onto the backside of sheet 46 to aid in inducing the transfer of toner from the photoconductive surface 12 to support material 46. It will be understood by those of skill in the art that the pin array corona generating device of the present invention can be utilized as transfer corotron 56. The support material 46 is subsequently transported in the direction of arrow 58 for placement onto a conveyor (not shown) which advances the sheet to a fusing station E. It will be further understood by those of skill in the art that the transfer station D may also include tack and detack corotrons embodied in the corona generating device of the present invention.

Fusing station E includes a fuser assembly, indicated generally by the reference numeral 60, for permanently affixing the transferred image to sheet 46. Fuser assembly 60 preferably comprises a heated fuser roller 62 and a support roller 64 spaced relative to one another for receiving a sheet of support material 46 therebetween. The toner image is thereby forced into contact with support material 46 between fuser rollers 62 and 64 to permanently affix the toner image to support material 46. After fusing, chute 66 directs the advancing sheet of support material 46 to receiving tray 68 for subsequent removal of the finished copy by an operator.

Invariably, after the support material 46 is separated from the photoconductive surface 12 of belt 10, some residual developing material remains adhered to belt 10. Thus, a final processing station, namely cleaning station F, is provided for removing residual toner particles from photoconductive surface 12 subsequent to separation of the support material 46 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for purposes of the present application for patent to illustrate the general operation of an electrophotographic reproducing machine including at least one pin array corona generating device incorporating the features of the present invention. As described, the electrophotographic reproducing apparatus may take the form of any of several well known devices or systems such that variations of specific electrostatographic processing subsystems or processes may be expected without affecting the operation of the present invention.

Moving now to FIG. 1, there is shown a known configuration for a pin array corona generating device 80 wherein a pin array electrode 81 is supported in the corona generating device by support members extending along either side of the electrode 81. As illustrated, the prior art device comprises an electrode 81 including a pin array 82, supported by side support members 84 and positioned within a shield support frame comprising side shield elements 86. It will be understood that the side shield elements of the support frame are typically fabricated of a conductive material but may be fabricated of a non-conductive material for specific applications, such as, for example, in a detack charge apparatus for detacking a copy sheet from the photoconductive belt 10.

Side support members 84 comprise elongate members disposed on either side of pin array electrode 81 such that the electrode 81 is sandwiched therebetween. Side support members 84 extend between end mounting blocks 87 and 88 for supporting the electrode within the conductive shield. In a typical embodiment, the pin array electrode 81 is welded, or attached in some other manner, to side support members 84 which, in turn, are fixedly mounted into support slots (not shown) in each end mounting blocks 87 and 88. A central support element 83, adapted to receive the pin electrode 81/side support member 84 combination, is also provided for being mounted to side shield member 86 in order to add structural integrity to the pin array corona generating device 80.

Pin array electrode 81 preferably comprises a thin, elongate member fabricated from a highly conductive material having an array of integral projections such as pins including triangular teeth or scalloped edges along one edge thereof and extending along the entire length of an edge of the elongate member in a direction towards a surface to be charged (not shown). Pin array electrode 81 may be coupled to a high-voltage extension member 85, or may be provided with an integral high voltage extension member for electrical connection of the pin electrode 81 to a high-voltage power source (not shown). The pin array electrode 81 has a length approximately equal to the width of the surface to be charged, and a height sufficient to expose the teeth thereof when mounted between the side support members 84, which is required to provide proper charging characteristics. In a preferred embodiment, the pin array electrode 81 has a thickness of approximately 0.08 mm (0.03 inches) and the teeth of pin array 82 extend approximately 3.5 mm (0.1.36 inches) from the top edge of the side support member 84 at a pin tip-to-pin tip interval of approximately 3 mm (0.12 inches). It will be understood that, although the present invention is described with reference to a pin electrode, the features of the present invention described in further detail herein could be used in conjunction with a typical wire electrode as known in the art or may be useful in other configurations outside of the realm of corona generating devices and assemblies.

With the understanding that any kind of looseness or kinks in the pin array electrode 81 will lead to non-uniform charging of the electrophotoreceptive belt or other surface to be charged, the present invention is directed to a tension mounting for supporting a corona generating electrode on an assembly similar to that shown in FIG. 1. Slackness also results in non-uniform spacing of the electrode from the surface and increases the chances of vibration being set up in the electrode while operating. In order to alleviate the problem of non-uniform charging due to these causes, an arrangement is provided by the present invention to selectively provide a predetermined tension in the electrode while also allowing tension to be released for removal and replacement of the electrode in the corona generating device 80.

Referring now more particularly to FIGS. 2–8, an exemplary embodiment of corona charging device 80, incorporating the specific features and the subject matter of the present invention, is illustrated and will be described in greater detail. As in the prior art device, the primary components of the corona charging device 80 are pin array electrode 81, side shield members 86, and end mounting blocks 87 and 88, as shown in FIG. 1. In a preferred embodiment of the present invention, at least one end mounting block of the corona charging device 80, for example end mounting block 88, includes a tension support mounting in accordance with the present invention. While the present description will proceed under the assumption that the end mounting block opposite the tension support mounting of the present invention operates to receive the electrode 81 in a fixed mounting position as is known in the art, it is contemplated that the corona generating device may include a pair of tension support mountings in accordance with the present invention positioned at opposite ends of the corona generating device for supporting the electrode between the side shield members 86.

Figure 2:
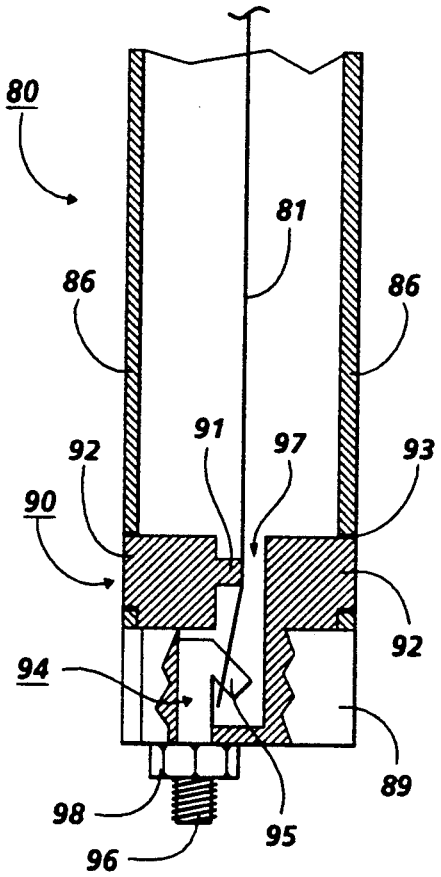
FIG. 2 is a plan view in partial cross section of one embodiment of a tension support mounting for a corona generating device in accordance with the present invention.
Figure 4:
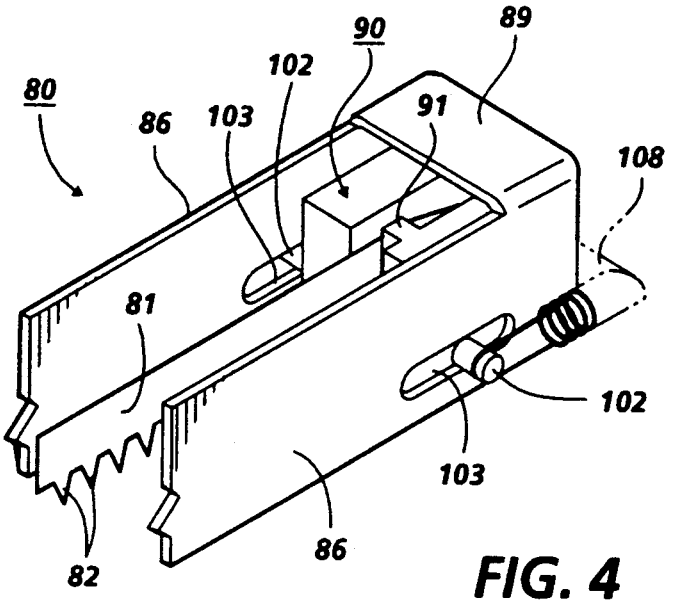
Figure 8:
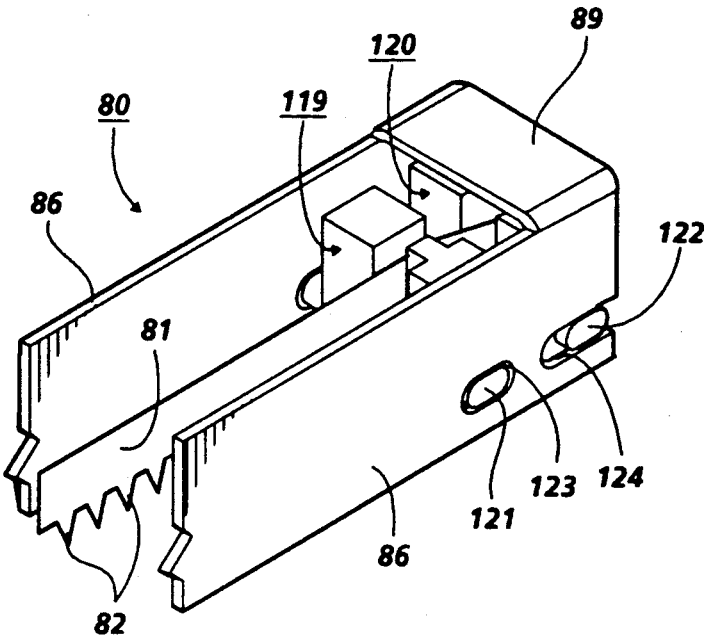

Moving now, initially, to the exemplary embodiment of FIG. 2, the illustrated embodiment shown thereat comprises a mounting block 90 disposed between side shield elements 86, adjacent an endpiece 89 for connecting the side shield elements 86. Although endpiece 89 is shown as a connecting piece located on a plane parallel with the pin array electrode 81, the endpiece 89 may alternatively be positioned in a plane perpendicular to the pin array 81 in a configuration similar to that shown in FIG. 1, adjacent to mounting block 88. In the particular embodiment of FIG. 2, the mounting block 90 includes a pair of support projections 92 extending in a direction opposed to the side shield elements 86 for cooperative engagement with support projection apertures 93, as may be more clearly understood by reference to FIGS. 4 and 8 showing alternative embodiments of the present invention in perspective view. The support projection apertures 93 operate in combination with the support projections 92 to maintain the mounting block 90 in fixed position between side shield elements 86. A threaded screw hook 94 including a threaded shaft 96 and a hook segment 95 as well as a cooperatively threaded mounting nut 98 are also provided. Mounting block 90 also includes a channel 97 for allowing passage of the pin electrode 81 to the hook segment 95 and an alignment finger 91 projecting into channel 97 for contacting the pin electrode 81 to align the electrode between the side shield elements 86.

In the embodiment of FIG. 2, the electrode 81 is secured to the hook segment 95 of threaded hook screw 94 which acts as a means for supporting the electrode 81. Mounting nut 98 is threaded onto threaded shaft 96, and pushes against mounting block 90 to selectively position the hook segment 95 relative to the fixed position of the mounting block 90. Thus, the tension support mounting of the present embodiment applies tension to the pin array electrode 81 by means of tightening mounting nut 94. A specified tension can be applied by tightening mounting nut 94 to a predetermined torque setting. Conversely, tension on the pin array electrode 81 can be reduced by loosening mounting nut 94. In this manner, the tension support mounting of the present invention can be used to remove the pin array electrode 81 from the corona generating apparatus in order to, for example, replace the pin array electrode 81.

Preferably, the mounting block 90, as well as threaded screw hook 92 and nut 94 of this embodiment of the present invention are fabricated from a high strength insulator such as polyvinyl fluoride for preventing arcing or other current flow beyond the periphery of the corona generating device. Alternatively, the threaded screw hook 92 may be fabricated from a highly conductive material for coupling the electrode 81 to a high voltage power supply (not shown) for application of a corona generating potential to the pin array electrode 81. It is noted, however, that if threaded screw hook 92 is fabricated from a conductive material, the portion of threaded segment 96 which extends beyond mounting nut 94 must be properly insulated or located far enough from any other conductive part of the charging device, as well as any other conductive part in the machine environment, so as not to provide a potential corona forming surface or any potentially hazardous conditions.

Figure 3:
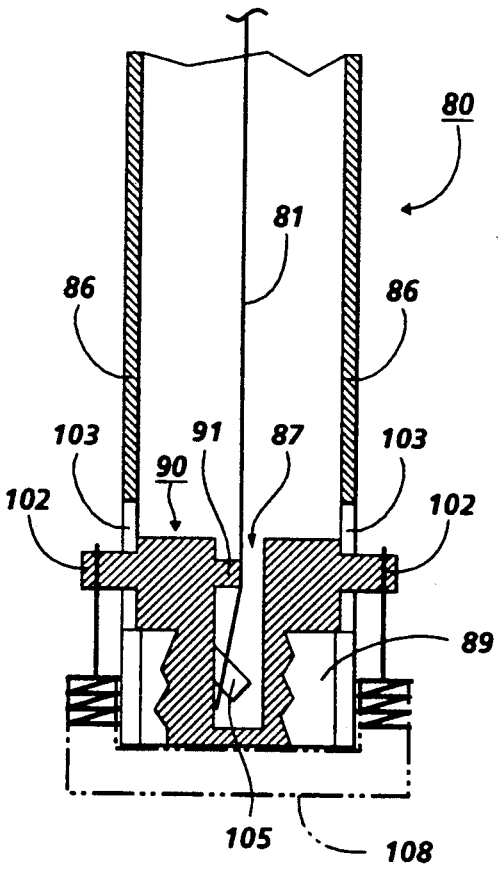
FIGS. 3 and 4 are plan and perspective views, respectively, of another embodiment of a tension support mounting for a corona generating device in accordance with the present invention.

An alternative embodiment of the present invention is illustrated in FIGS. 3 and 4, wherein mounting block 90 includes an integral hook element 105 extending into channel 97 for receiving and securing the pin array electrode 81 thereto to support the electrode between the side shield elements 86, in a manner similar to that shown and described with respect to the embodiment of FIG. 2. As in the previous embodiment, the mounting block 90 also includes an alignment finger 91 protruding into channel 97 for aligning the pin array electrode 81 between side shield members 86. The mounting block 90 also includes a pair of support projections 102 opposing side shield elements 86. Side shield elements 86 include cooperative support projection apertures 103 having a lengthwise dimension greater than the dimension of the support projection 102 for permitting limited longitudinal travel of mounting block 90 within the conductive shield of corona generating device 80. As such, mounting block 98 is slidably disposed within the conductive shield of the corona generating device 80. The tension support mounting of this embodiment further includes a resilient spring member 108 attached to each support projection 102 and extending about the periphery of the corona generating device 80. As such, the resilient spring member 108 supplies a force for urging the mounting block toward the end of the corona generating device, thereby applying tension to the pin array electrode 81. Conversely, the spring member 108 can be detached from a support projection for releasing tension on the electrode 81 and permitting replacement thereof. It will be understood that various spring members having various lengths or tensioning strength can be utilized to permit selective application of tension to electrode member 81.

Figure 5:
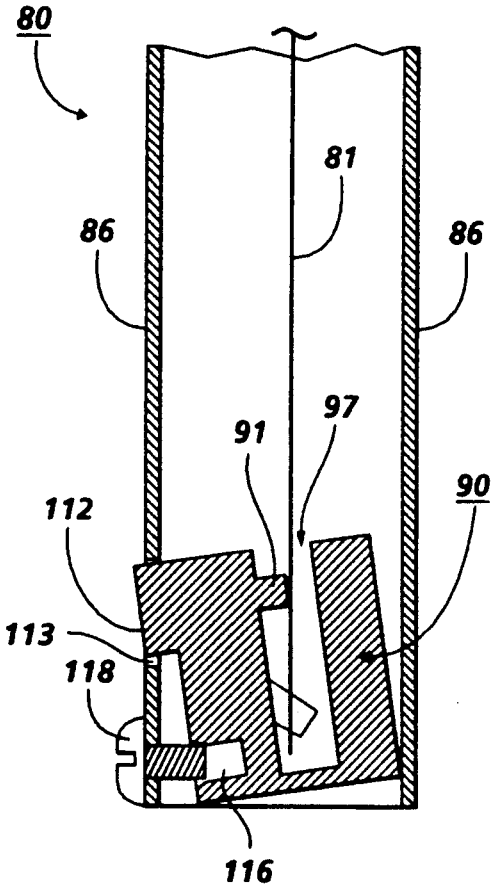
FIGS. 5 and 6 are plan views of yet another embodiment of a tension support mounting for a corona generating device in accordance with the present invention, showing the tension support mounting in a loosened and a tensioned position, respectively.
Figure 6:
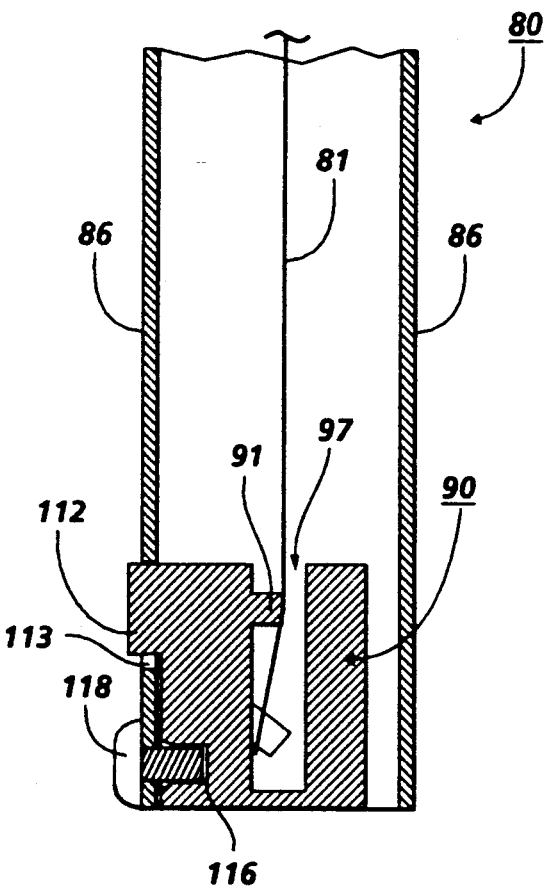

In another alternative embodiment of the present invention, as shown in FIGS. 5 and 6, mounting block 90 includes an integral hook element 115 and an alignment finger 91 both extending into channel 97. The mounting block has a dimension that is substantially less than the lateral dimension separating side members 86. In this embodiment, mounting block 90 includes a pivot shoulder 112 extending through a pivot aperture 113 located in one of the shield members 86. The tension support mounting of this embodiment also includes a tension screw 118 extending through the shield member 86 adjacent the pivot aperture 113 for being threaded into a threaded cavity 116 in the mounting block 90. In this embodiment, the tension screw 118 is threaded into the threaded cavity 116 in mounting block 90 for pivoting the mounting block 90 about pivot shoulder 112, thereby drawing the surfaces of the mounting block 90 and the shield member 86 into abutting contact with one another as shown in FIG. 6. The variable pivoting action of this embodiment provides means for applying selective tension to the pin array electrode 81.

Figure 7:
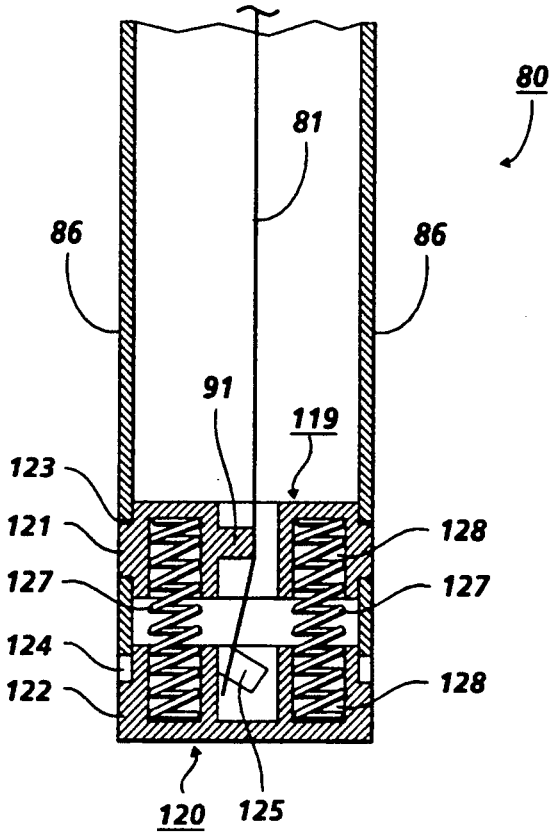
FIGS. 7 and 8 are plan and perspective views, respectively, of still another embodiment of a tension support mounting for a corona generating device in accordance with the present invention.

Yet another alternative embodiment for implementing the objectives of the present invention is shown in FIGS. 7 and 8, wherein the tension support mounting comprises two cooperative mounting block members 119 and 120 individually mounted between side shield elements 86 in a fixed and slidable configuration, respectively. Each mounting block member includes a channel 97 while the fixed mounting block member includes alignment finger 91 and the slidably mounted mounting block member 120 includes an integral electrode receiving hook 125 for supporting electrode 81. Fixedly mounted member 119 includes a pair of support projections 121 extending into support projection apertures 123 and slidably mounted member 120 includes support projections 122 which extend into support projection apertures 124. A pair of resilient spring members 127 are provided between the fixed and slidably mounting block members mounted into cooperative receiving pockets 128 such that the slidable block 120 is urged away from the fixed block 119 to thereby provide a tensioning force to the pin electrode to pull the electrode firmly taut. As in the embodiment of FIGS. 5 and 6, it will be understood that various spring members having various lengths or compression characteristics can be utilized to permit selective application of tension to the electrode 81.

In recapitulation, it should be clear from the foregoing discussion that the present invention provides various embodiments of a novel mounting apparatus for applying tension to an electrode in a corona generating device. The electrode is secured to an electrode support member which is capable of being selectively positioned so as to permit selective application of tension to the electrode. The novel mounting apparatus maintains the electrode in a taut formation within the corona generating device and allows for on-site adjustment and replacement of the electrode rather than replacement of the entire corona generating device assembly.

It is, therefore, apparent that there has been provided, in accordance with the present invention, a corona generating device that fully satisfies the aims and advantages set forth hereinabove. While the present invention has been described in conjunction with various specific embodiments thereof, it will be evident to those skilled in the art that many alternatives, modifications and variations are possible to achieve the desired results. Accordingly, the present invention is intended to embrace all such alternatives, modifications, and variations which may fall within the spirit and scope of the following claims.

We claim:

1. A corona generating device, comprising:

an electrode member including an elongated strip having an edge with an array of integral projections extending therefrom;

means for supporting said electrode member including a shield member having a pair of side shield elements and an end piece connected therebetween, said electrode member being supported between said side shield elements; and means for selectively applying tension to said electrode member being supported by said supporting means.

2. The corona generating device of claim 1, wherein said tension applying means includes:

a mounting block disposed adjacent said endpiece between said side shield elements; and electrode support means for securing said electrode member to said mounting block, said electrode support means being selectively positionable within said shield member.

3. The corona generating device of claim 2, wherein said mounting block includes a channel for receiving said electrode member, said electrode support means being disposed in said channel.

4. The corona generating device of claim 3, wherein said mounting block further includes an alignment finger projecting into said channel for contacting said electrode member to align said electrode member between said side shield elements.

5. The corona generating device of claim 2, wherein:

said electrode support means is integral with said mounting block; and said mounting block is slidably disposed between said side shield elements.

6. The corona generating device of claim 5, further including means for varying the position of said mounting block relative to said endpiece to permit selective application of tension to said electrode member.

7. The corona generating device of claim 5, wherein:

said mounting block includes an integral support projection extending in a direction opposed to said shield member; and said shield member defines a support projection aperture for receiving said support projection so as to permit slidable movement of said mounting block within said shield member.

8. The corona generating device of claim 7, further including means for urging said mounting block in a direction toward said endpiece to apply tension to said electrode member.

9. The corona generating device of claim 8, wherein said urging means includes a resilient spring member coupled to said support projection and about a periphery of said endpiece.

10. The corona generating device of claim 2, wherein:

said electrode support means is integral with said mounting block; and said mounting block is pivotably mounted between said side shield elements.

11. The corona generating device of claim 10, wherein:

said mounting block includes a pivot shoulder extending in a direction opposed to said shield member, said shield member defines a pivot aperture for receiving said pivot shoulder to permit pivotable movement of said mounting block within said conductive shield member.

12. The corona generating device of claim 11, further including means for varying the position of said mounting block to permit selective application of tension to said electrode member.

13. The corona generating device of claim 10, with said mounting block defining a threaded cavity, wherein said varying means includes an adjustment screw, in threaded engagement with said threaded cavity, for varying the position of said mounting block to permit selective application of tension to said electrode member.

14. The corona generating device of claim 1, with said mounting block being disposed in a substantially fixed position between said side shield elements, said electrode support means including means for varying the position thereof relative to said mounting block to permit selective application of tension to said electrode member.

15. The corona generating device of claim 14, wherein said electrode support means includes:

a threaded screw hook comprising a threaded shaft and a hook segment integral therewith, said electrode member being secured to said hook segment; and a threaded nut cooperative with said threaded shaft for situating said hook segment into a selected position relative to said mounting block so as to apply selective tension to said electrode member secured to said hook segment.

16. The corona generating device of claim 14, wherein:

said electrode support means comprises an insulative material; and said mounting block comprises an insulative material for electrically isolating said electrode member.

17. The corona generating device of claim 14, wherein said electrode support means comprises a conductive material for conducting an electrical biasing potential to said electrode member.

18. The corona generating device of claim 14, wherein:

said mounting block includes an integral support projection extending in a direction opposed to said shield member; and said shield member defines a support projection aperture for receiving and locking said support projection so as to support said mounting block in a substantially fixed position.

19. The corona generating device of claim 1, wherein said mounting block includes:

a first member fixedly disposed between side shield elements;

a second member slidably disposed between said side shield elements; and a resilient member for urging said first and second members in opposite directions.

20. The corona generating device of claim 19, wherein:

said first member includes an alignment finger for aligning said electrode between said side shield members; and said second member includes an integral hook element for securing said electrode member thereto.

21. The corona generating device of claim 20, wherein: said first and second mounting block members each include an integral support projection extending in a direction opposed to said shield member; and said shield member includes:

a first support projection aperture for receiving said first mounting block member support projection in an interlocking manner so as to support said first member in a fixed position; and a second support projection aperture for receiving said second mounting block member support projection in a slidable manner to permit slidable movement of said second mounting block member within said conductive shield member.

* * * * *